US006755337B2

(12) United States Patent
Jairam et al.

(10) Patent No.: US 6,755,337 B2
(45) Date of Patent: Jun. 29, 2004

(54) POWERED STAPLER AND ADJUSTABLE BASE ASSEMBLY

(75) Inventors: Anthony Jairam, Sunrise, FL (US); Bikram Sohi, Wheeling, IL (US)

(73) Assignee: ACCO Brands, Inc., Lincolnshire, IL (US)

( * ) Notice: Subject to any disclaimer, the term of this patent is extended or adjusted under 35 U.S.C. 154(b) by 0 days.

(21) Appl. No.: 10/078,621

(22) Filed: Feb. 19, 2002

(65) Prior Publication Data

US 2003/0155398 A1 Aug. 21, 2003

(51) Int. Cl.[7] ..... B25C 7/00
(52) U.S. Cl. ..... 227/148; 227/140; 227/156
(58) Field of Search ..... 227/4, 7, 131, 227/134, 156, 109, 148, 140

(56) References Cited

U.S. PATENT DOCUMENTS

| | | | | | |
|---|---|---|---|---|---|
| 1,271,548 | A | | 7/1918 | Doig | |
| 2,685,689 | A | | 8/1954 | Morse | |
| 3,282,489 | A | | 11/1966 | March | |
| 3,640,443 | A | * | 2/1972 | Itagaki | 227/120 |
| 4,186,863 | A | * | 2/1980 | Yunoki | 227/131 |
| 4,288,019 | A | * | 9/1981 | Dahle | 227/144 |
| 4,405,073 | A | * | 9/1983 | Salleras Escalante | 227/120 |
| 4,589,581 | A | | 5/1986 | Balma | |
| 4,795,073 | A | * | 1/1989 | Yamamoto et al. | 227/120 |
| 4,838,470 | A | * | 6/1989 | Chang | 227/156 |
| 5,222,645 | A | | 6/1993 | Sueda | |
| 5,237,750 | A | * | 8/1993 | Nakano et al. | 30/131 |
| 5,330,086 | A | * | 7/1994 | Shimomura et al. | 227/7 |
| 5,657,918 | A | * | 8/1997 | Shimomura et al. | 227/7 |
| 5,690,268 | A | * | 11/1997 | Evans et al. | 227/156 |
| 5,797,535 | A | * | 8/1998 | Lovegrove et al. | 227/120 |
| 5,842,624 | A | | 12/1998 | Ishida | |
| 6,068,173 | A | * | 5/2000 | Sueda | 227/7 |
| 6,135,337 | A | * | 10/2000 | Harris et al. | 227/131 |

OTHER PUBLICATIONS

Prior art Electric Staplers, Acco Product Catalog pp. 188–189, (undated).

* cited by examiner

*Primary Examiner*—Rinaldi I. Rada
*Assistant Examiner*—Gloria Weeks
(74) *Attorney, Agent, or Firm*—Michael Best & Friedrich LLP

(57) ABSTRACT

A stapler assembly includes a base and a stapler coupled to the base. The stapler is movable with respect to the base between a first position, wherein the stapler has a first orientation with respect to the base, and a second position, wherein the stapler has a second orientation with respect to the base. The base preferably includes a holster configured to receive the stapler and is pivotable to move the stapler between the first and second positions. A cradle supports the holster. A detent mechanism between the cradle and the holster includes at least two detents corresponding with the first and second stapler positions. Preferably, the stapler is an electric stapler and the base includes an electrical conductor configured to conduct power from a power supply cord to the stapler when the stapler is received in the base.

28 Claims, 4 Drawing Sheets

POWERED STAPLER AND ADJUSTABLE BASE ASSEMBLY

FIELD OF THE INVENTION

The invention relates to staplers, and more particularly to powered staplers.

BACKGROUND OF THE INVENTION

Powered staplers are well known and allow a user to staple sheets without any significant manual input of force to the stapler. The user simply inserts the sheets to be stapled between the magazine and the anvil, and a staple is automatically, or at the press of a button, dispensed to fasten the sheets together. Electric staplers are typically powered by an AC current supply, and thus are plugged into an outlet near the user's workspace. The stapler commonly rests on the user's desktop or countertop such that the magazine and the anvil are spaced apart vertically to define a substantially horizontal sheet infeed slot. Sheets to be stapled are inserted into the slot in a substantially horizontal direction.

SUMMARY OF THE INVENTION

Prior art electric staplers have disadvantages, especially when used in environments requiring high-volume stapling, such as office services departments, copy rooms, and the like. In these high-volume applications, the user is typically standing at a counter or a desk and must often bend down to align the sheets with the horizontal infeed slot. As a result, efficiency and productivity can be reduced.

To overcome this problem, the invention provides an electric stapler and adjustable base assembly. The base assembly includes a cradle and a holster that is movable with respect to the cradle. A portion of the stapler is received in the holster such that the stapler and the holster can be moved with respect to the cradle between a first position, wherein the stapler is supported in a first orientation with respect to the cradle, to a second position, wherein the stapler is supported in a second orientation with respect to the cradle. The orientation of the infeed slot of the stapler changes between the first and second positions, allowing the user to orient the stapler as desired for more efficient stapling. The base includes detents that allow it to be secured in the first and second positions and can also include additional stapling positions.

The base assembly can rest directly on a horizontal work surface or, alternatively, can be mounted on other surfaces, such as nearby walls or other vertical members of the desk or counter. The base assembly therefore enables the stapler to be stored in out-of-the way, yet accessible locations. The power cord can be plugged directly into the base, or, when the stapler is removed from the holster, the power cord can be plugged directly into the stapler.

The base assembly can include an electrical connector electrically connected to a power supply such that when the stapler is supported by the base, the connector is coupled to the stapler to provide power to the stapler. Preferably, the electrical connector is on the holster and the electrical connector is electrically connected to a power supply cord plugged into the cradle. A flexible conductor can be connected between the power supply cord and the electrical connector to maintain an electrical connection between the holster and the cradle during movement of the holster.

The invention also provides a method of using a stapler assembly having a stapler and a base. The method includes coupling the stapler to the base (e.g., a holster) such that the stapler is in a first position with respect to the base, and stapling a plurality of sheets while the stapler is in the first position. While the stapler is coupled to the base, the stapler is moved (e.g., pivoted) to a second position with respect to the base, and a plurality of sheets is stapled while the stapler is in the second position.

The invention also provides a method of using a stapler assembly having an electric stapler and a base. The base includes an electrical connector electrically connected to a power supply cord plugged into the base. The method includes coupling the stapler to the base, inserting the connector into the stapler to provide power to the stapler, and stapling a plurality of sheets.

In one aspect of the invention, the base includes a holster, and coupling the stapler to the base includes inserting the stapler into the holster. Preferably, inserting the stapler into the holster includes inserting the connector into the stapler to provide power to the stapler. Further preferably, inserting the connector into the stapler occurs automatically and substantially simultaneously with the insertion of the stapler into the holster. In another aspect of the invention, the method further includes uncoupling the stapler from the base, unplugging the power supply cord from the base, plugging the power supply cord directly into the stapler, and stapling a plurality of sheets while the stapler is uncoupled from the base.

Other features and advantages of the invention will become apparent to those skilled in the art upon review of the following detailed description, claims, and drawings.

Figure 1:
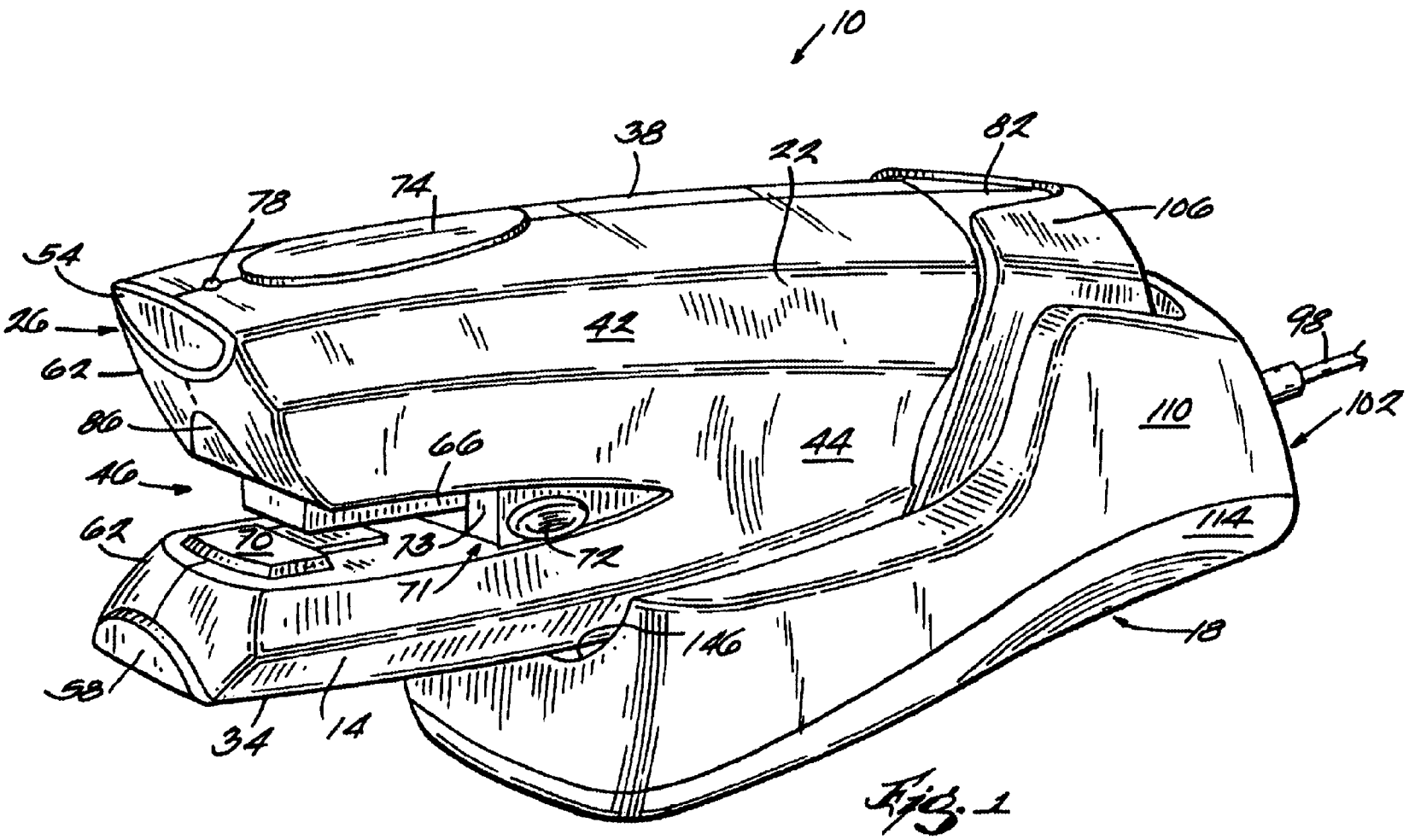
FIG. 1 is a perspective view of a stapler assembly embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIGS. 1–6 illustrate a stapler assembly 10 embodying the invention. The stapler assembly 10 includes a stapler 14 and a base assembly 18 configured to receive the stapler 14. In the illustrated embodiment, the stapler 14 is an electric stapler having a body portion 22. The body portion 22 includes a front end 26, a rear end 30, a bottom surface 34, a top surface 38, and opposing side surfaces 42. Each side surface 42 defines a side recess 44. As used herein and in the appended claims, the terms front, rear, bottom, top, upper, and lower are used for the purpose of illustration only, and are not intended to imply any particular orientation.

The body portion 22 is configured to define an infeed slot 46 adjacent the front end 26. The infeed slot 46 defines an infeed axis 50 that is substantially parallel to the longitudinal axis of the stapler 14. The infeed slot 46 divides the front end 26 of the stapler 14 into an upper nose portion 54 and a lower nose portion 58. The nose portions 54 and 58 preferably include tapered surfaces 62 to facilitate insertion of a plurality of sheets (not shown) into the infeed slot 46 for stapling.

A magazine 66 is coupled to the upper nose portion 54 adjacent a first side of the infeed slot 46, and an anvil 70 is coupled to the lower nose portion 58 adjacent a second side of the infeed slot 46. The magazine 66 includes an opening (not shown) for dispensing a staple (not shown) through a plurality of sheets positioned in the infeed slot 46. When the legs of the staple contact the anvil 70 they are bent and crimped, thereby fastening the sheets in a manner understood by those skilled in the art.

The stapler 14 also includes a paper guide mechanism 71 slidably positioned in the infeed slot 46. The paper guide mechanism 71 includes opposing projections 72 that facilitate the user grasping the paper guide mechanism 71 and sliding the paper guide mechanism 71 back and forth in the direction of the infeed axis 50. As is understood by those skilled in the art, the paper guide mechanism 71 functions to adjustably limit the effective length of the infeed slot 46 so that the staple is dispensed at the desired location relative to the plurality of sheets being stapled.

The paper guide mechanism 71 includes a wall or spring-tab 73 (see FIG. 1) configured to automatically actuate the dispensing of a staple. In the illustrated embodiment, the wall 73 is spring-loaded such that when sheets of paper being inserted into the infeed slot 46 contact the wall 73, the wall 73 is deflected toward the rear end 30 of the stapler 14. This deflection actuates the dispensing of a staple in a known manner. Of course other types of proximity sensors or vision sensors can also be used to automatically actuate stapling. Alternatively, the stapler 14 could include a manual push-button to activate stapling.

The stapler 14 further includes a logo portion 74 and a low staple indicator 78 in the form of a light bulb or LED on the top surface 38. In the illustrated embodiment, the low staple indicator 78 is illuminated when the supply of staples in the magazine 66 falls below a predetermined number (e.g., ten staples). Of course, the location of the logo portion 74 and the indicator 78 can vary as desired.

The magazine 66 is slidably coupled to a cartridge assembly (not shown) so that the magazine 66 can be opened via a magazine release button 82 (see FIGS. 4 and 5) near the rear end 30 of the stapler 14. When the button 82 is depressed, the magazine 66 slides out from the front end 26 and can be loaded with staples. A grip portion 86 facilitates opening and closing the magazine 66. The rear end 30 also includes an electrical socket 90 configured to receive a mating electrical connector. As will be described in greater detail below, the electrical socket 90 is configured to receive an electrical connector 94 of a power supply cord 98 (see FIG. 4), or an electrical connector that is coupled to the base assembly 18.

Figure 2:
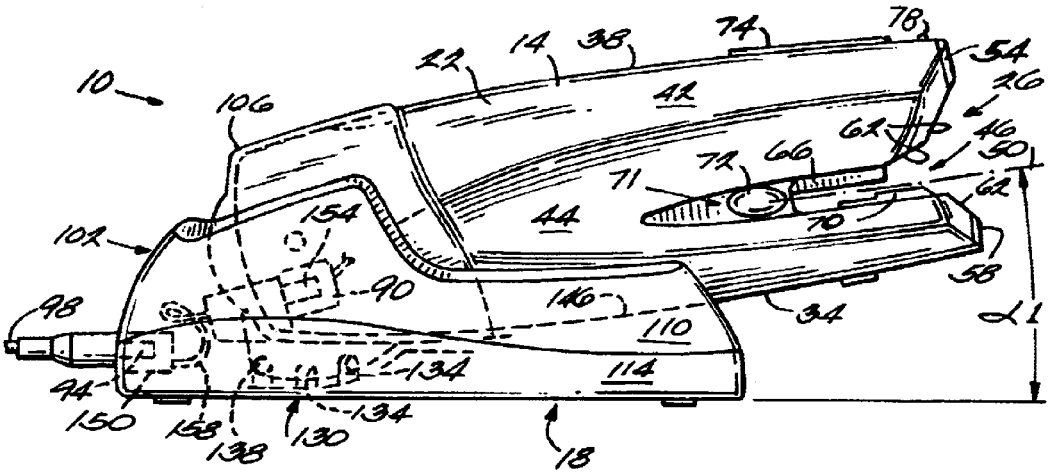
FIG. 2 is a side view of the stapler assembly of FIG. 1, shown in a first position.
Figure 3:
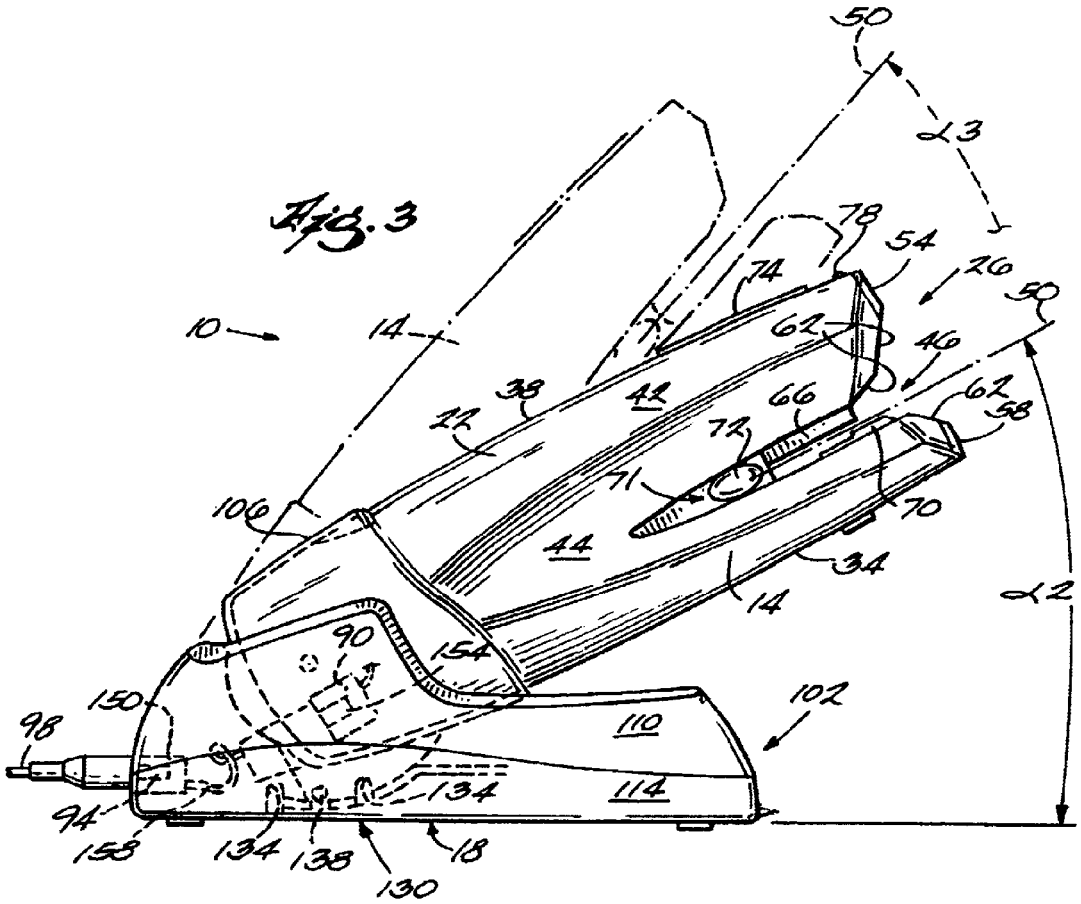
FIG. 3 is a side view of the stapler assembly of FIG. 1, shown in second and third positions.

The base assembly 18 is configured to removably receive and support the stapler 14 in a plurality of predetermined positions (see FIGS. 2 and 3). In the illustrated embodiment, the base assembly 18 includes a cradle 102 and a holster 106 pivotally mounted to the cradle 102. The holster 106 can be moved relative to the cradle 102 so that the stapler 14 can be quickly and easily moved between a plurality of angled stapling positions relative to the base assembly 18.

The cradle 102 is preferably a two-piece part defined by an upper half 110 and a lower half 114. In the illustrated embodiment, the cradle is a molded plastic part. The holster 106 is configured to receive the rear end 30 of the stapler 14 and is pivotally coupled to the cradle 102 to pivot about projections 118 (see FIG. 6) extending outwardly from either side of the holster 106. In the illustrated embodiment, the holster 106 is also a molded plastic part, and the pivot projections 118 are sandwiched or retained between the upper half 110 and the lower half 114 of the cradle 102.

One of ordinary skill in the art would understand that the pivotable mounting of the holster 106 in the cradle 102 could be achieved in various other ways without departing from the scope of the invention. In addition, other types of structures incorporating other forms of movement could also be employed. For example, ball-and-socket configurations or curvilinear tongue-and-groove configurations could be used to generate the relative movement between the holster 106 and the cradle 102. Furthermore, other materials, such as metals, could be substituted for the cradle 102 and the holster 106.

Referring to FIGS. 2–6, the base assembly 18 further includes a detent mechanism 130 cooperating between the cradle 102 and the holster 106 to provide a plurality of predetermined and substantially secured pivot positions for the holster 106 and the stapler 14. In the illustrated embodiment, the detent mechanism 130 includes three pair of spaced-apart recesses or detents 134 formed in the lower half 114 of the cradle 102, and a pair of spaced-apart projections 138 that extend from respective extensions 142 (see FIG. 6) on the underside of the holster 106.

Figures 4, 5:
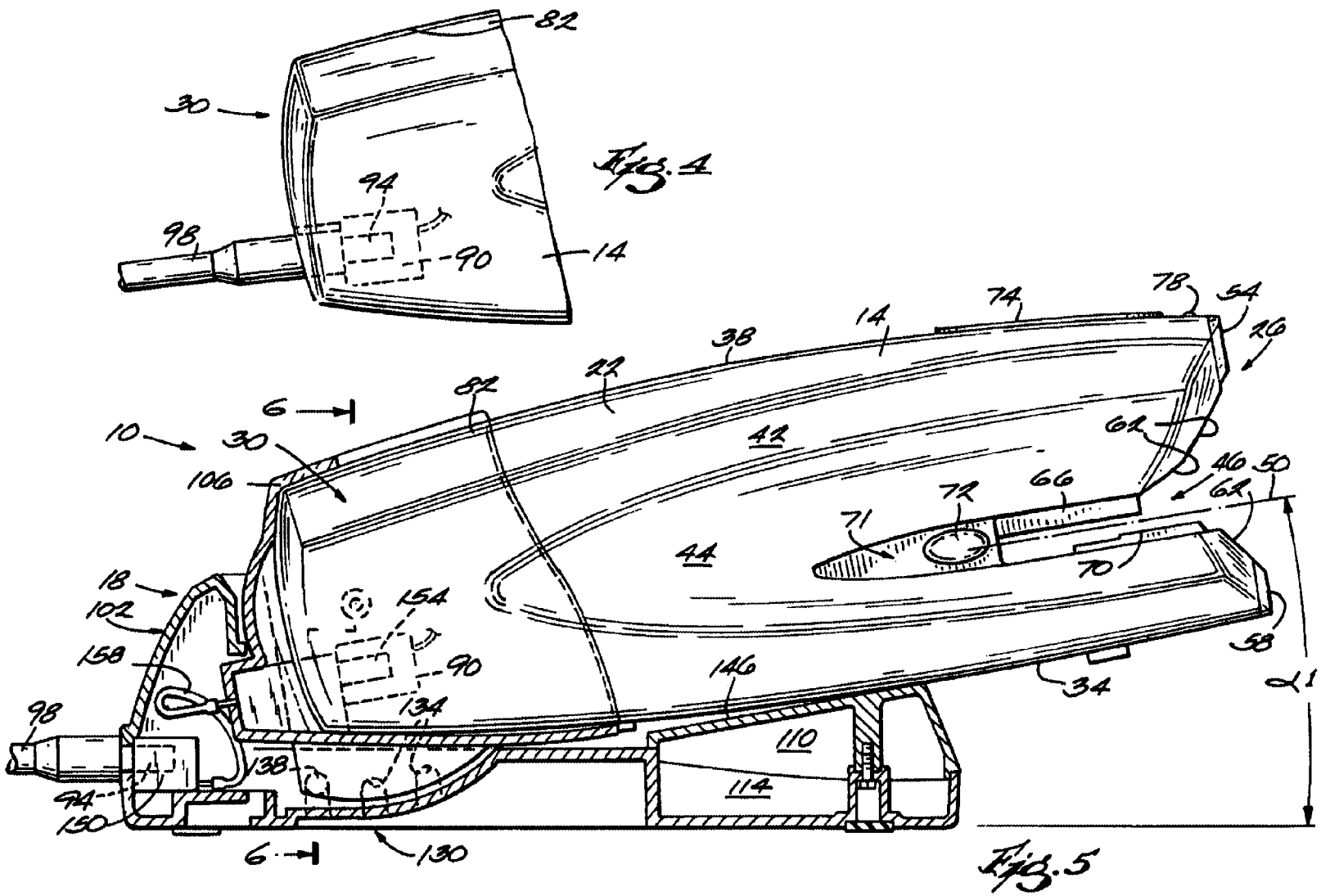
FIG. 4 is a partial side view showing the stapler removed from the base assembly.
FIG. 5 is an enlarged side view with the base assembly shown in section.

FIGS. 1, 2, and 5 illustrate the holster 106 and stapler 14 pivoted to a first position or orientation with respect to the cradle 102. In this first position, the projection 138 is located in the recess 134 furthest to the left, as viewed in FIGS. 2 and 5. When the stapler 14 and the holster 106 are in the first position, at least a portion of the bottom surface 34 of the stapler 14 rests on and is supported by a support tray 146 defined by the upper half 110 of the cradle. The infeed axis 50 is oriented at a first incline angle $\alpha 1$ with respect to the bottom surface of the cradle 102. In the illustrated embodiment, the incline angle $\alpha 1$ is approximately ten degrees, however other angles can be substituted. The first position may facilitate stapling for a shorter user standing adjacent a desk or for a user who is sitting at a desk.

Depending on the location of the stapler assembly 10 and the position/height of the user, stapling may be facilitated by pivoting the holster 106 an therefore the stapler 14, to a second position or orientation, wherein the infeed slot 46 is oriented differently with respect to the cradle 102. The solid line rendition in FIG. 3 illustrates the holster 106 and stapler 14 in a second position with respect to the cradle 102. In this second position, the projection 138 is located in the middle recess 134, as viewed in FIG. 3. When the stapler 14 and the holster 106 are in the second position, the bottom surface 34 of the stapler 14 is no longer supported by the support tray 146. The infeed axis 50 is oriented at a second, steeper incline angle $\alpha 2$ with respect to the bottom surface of the cradle 102. In the illustrated embodiment, the incline angle $\alpha 2$ is approximately twenty-seven and one-half degrees;

seventeen and one-half degrees steeper than the incline angle $\alpha 1$. The second position may facilitate stapling for a taller user standing or sitting near the stapler assembly 10.

Pivoting the stapler from the first position to the second position is done manually in the illustrated embodiment. The user grasps the stapler 14 while it is engaged in the holster 106 and then moves the stapler 14 toward the second position. With sufficient force, the somewhat resilient projections 138 disengage from their respective first position recesses 134 (the left-most recess in FIGS. 2 and 3) and move toward the second position recesses 134 (the middle recess in FIGS. 2 and 3) until the projections 138 snap into the middle recesses 134, thereby substantially securing the holster 106 in the second position.

In this manner, the stapler 14 and holster 106 can be quickly moved between the illustrated stapling positions between consecutive stapling jobs. Of course, the holster 106 can also be pivoted between the various positions when the stapler 14 is removed from the holster 106, however, pivoting the holster 106 using the inserted stapler 14 facilitates the task due to the mechanical lever-type advantage gained by exerting force on the front end 26 of the stapler 14, a greater distance away from the pivot point.

Any number of positions can be achieved depending on the number of recesses 134 in the cradle 102. For example, FIG. 3 shows a third position (shown in phantom) in which the stapler 14 is pivoted such that the infeed axis 50 forms an even steeper, third incline angle $\alpha 3$ with respect to the bottom surface of the cradle 102. In the illustrated embodiment, the incline angle $\alpha 3$ is approximately forty-five degrees; thirty-five degrees steeper than the incline angle $\alpha 1$. In this third position, the projection 138 is located in the recess 134 furthest to the right, as viewed in FIG. 3. The third position may facilitate stapling for a taller user standing close to or directly over the stapler assembly 10.

It is to be understood that while the base assembly 18 is shown with the cradle 102 oriented to be supported by a substantially horizontal support surface (not shown), the cradle 102 could alternatively be coupled to an inclined surface or a substantially vertical support surface (such as a wall or other vertical member), wherein the base assembly 18 shown in FIGS. 2 and 3 would be rotated approximately ninety degrees in a counter-clockwise direction. In the same manner described above, the stapler 14 could be pivoted between the three illustrated positions as desired to facilitate stapling.

Figure 6:
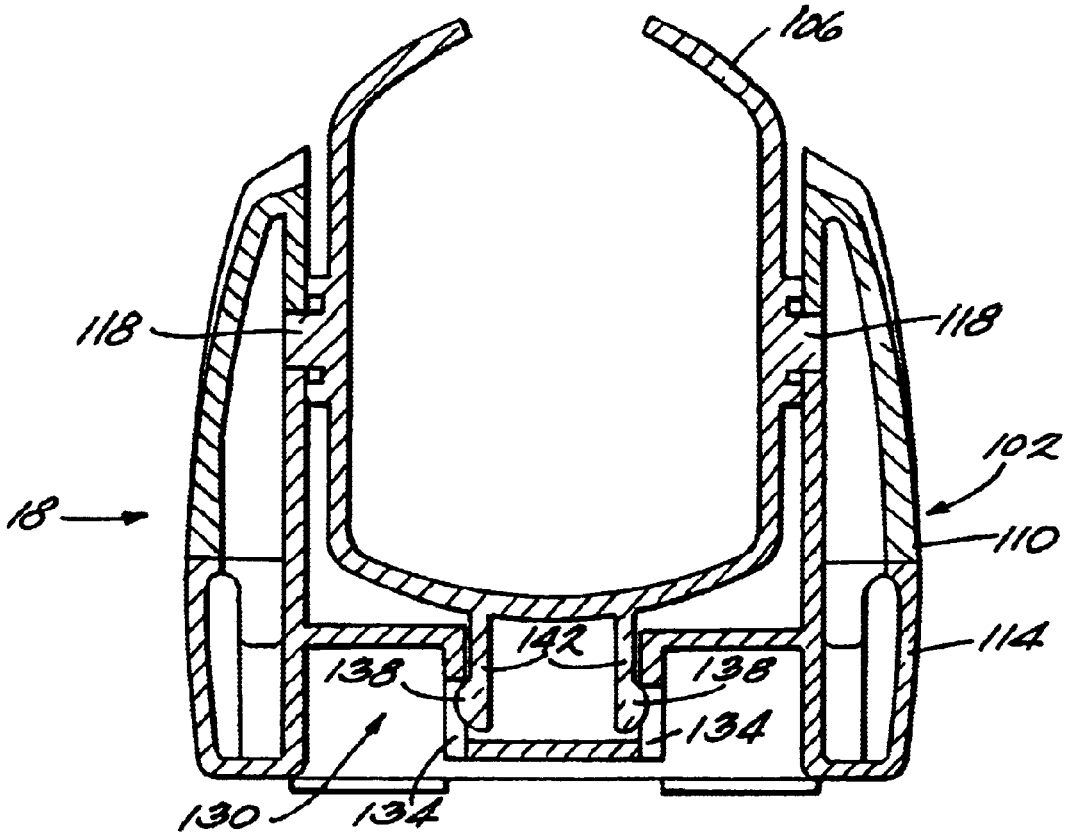
FIG. 6 is a section view taken along line 6—6 in FIG. 5, shown with the stapler removed.

Furthermore, one of skill in the art would recognize that the particular structure of the illustrated detent mechanism 130 could be modified without deviating from the invention. For example, the position of the recesses 134 and the projections 138 could be reversed. In addition, the location of the detent mechanism 130 could be moved from the underside of the holster 106 (as shown in FIG. 6) to either or both sides of the holster 106. The detent mechanism 130 could also be modified to change the illustrated incline angles to any desired angles.

Alternatively, the detent mechanism 130 could be replaced with other types of devices capable of substantially locking the holster 106 in a selected position with respect to the cradle 102. For example, friction locking mechanisms (e.g., set screws or spring-loaded pins) or positive locking mechanisms (e.g., bolts and wingnuts or spring-ball-loaded pushpins) could be used to allow for adjustment between desired positions.

In another alternative, the holster 106 and the cradle 102 can be assembled with a friction-fit such that the friction present between the holster 106 and the cradle 102 can be overcome by manually-applied force to set the position of the holster 106. Once the position is set, the friction force is sufficient to hold the holster 106 and the stapler 14 in the desired position. It is also understood that these alternatives could provide for more infinite adjustment of the holster 106. In other words, the number of possible position settings could be virtually infinite as opposed to the three distinct position settings shown in the illustrated embodiment.

As mentioned above, the illustrated stapler 14 is electrically powered, and therefore requires electrical power from a power supply (an AC current supply in the illustrated embodiment). In FIG. 4, the stapler is shown removed from the base assembly 18 and the electrical connector 94 of the power supply cord 98 is plugged directly into the rear end 30 of the stapler 14. When it is desired to couple the stapler 14 to the base assembly 18 by inserting the rear end 30 of the stapler 14 into the holster 106, the user first unplugs the power supply cord 98 from the stapler 14 and plugs the electrical connector 94 into a socket 150 housed in the base assembly 18. In the illustrated embodiment, the socket 150 is housed in the cradle 102.

The base assembly 18 is provided with an electrical connector 154 that is substantially similar to the electrical connector 94. In the illustrated embodiment, the electrical connector 154 is coupled to the holster 106 and extends into the stapler-receiving cavity defined by the holster 106. As the rear end 30 of the stapler 14 is inserted into the holster 106, the connector 154 is automatically and substantially simultaneously inserted into the socket 90 in the rear end 30 of the stapler 14. To electrically connect the socket 150 to the electrical connector 154 in the holster 106, a flexible conductor in the form of a wire 158 is coupled between the socket 150 and the electrical connector 154. The wire 158 is long enough and flexible enough to allow the electrical connection between the cradle 102 and the holster 106 to be maintained throughout the range of relative motion between the holster 106 and the cradle 102.

When the stapler 14 is removed from the holster 106, the electrical connector 154 automatically disengages the socket 90 in the stapler 14. To use the stapler 14 without the base assembly 18, the user unplugs the power supply cord 98 from the cradle 102 and plugs the electrical connector 94 directly into the socket 90 in the stapler 14. Alternatively, two separate power cords 98 can be used such that the base assembly 18 will always remain plugged-in. The second cord 98 can be used specifically for when the stapler 14 is disengaged from the base assembly 18.

In addition to the friction fit between the rear end 30 of the stapler 14 and the inner wall of the holster 106, the electrical connector 154 also helps to secure the stapler 14 in the holster 106. One skilled in the art would also recognize additional ways to help secure the stapler 14 in the holster 106. For example, the sidewalls of the holster 106 could be contoured to more closely follow the contours of the side surfaces 42 and could include curved portions configured to engage the side recesses 44. In one embodiment, the sidewalls of the holster 106 could include inwardly biased, resilient curved portions that engage the side recesses 44 and squeeze the stapler 14. Detent mechanisms could also be used to help secure the stapler 14 in the holster 106.

It should be understood that the illustrated electrical components and their respective locations can be modified by those skilled in the art. For example, instead of the illustrated electrical connectors, conductive contacts or other similar components can be used. In addition to providing direct electrical power in the form of AC current to the stapler 14, the base assembly 18 could also function as a charging stand for rechargeable, battery-powered (DC current) staplers. While not shown, the stapler 14 could include a rechargeable battery unit that would permit operating the stapler 14 in a cordless manner, in addition to use with the power supply cord 98. To recharge the battery, the stapler could be stored in the holster 106 such that the electricity provided via the electrical connector 154 would recharge the battery unit in the stapler.

Various features of the invention are set forth in the following claims.

What is claimed is:

1. A stapler assembly comprising:

a base having an electrical conductor; and an electric stapler coupled to the base, the stapler being movable with respect to the base between a first position, wherein the stapler has a first orientation with respect to the base and is capable of performing a stapling operation while in the first orientation, and a second position, wherein the stapler has a second orientation with respect to the base and is capable of performing a stapling operation while in the second orientation, wherein the stapler is coupled to the base in both the first and second positions;

wherein the electrical conductor is configured to conduct power from a power supply to the stapler when the stapler is coupled to the base.

2. The stapler assembly of claim 1, wherein the stapler includes a body portion defining an infeed slot;

a magazine adjacent a first side of the infeed slot, the magazine including an opening for dispensing a staple; and an anvil adjacent a second side of the infeed slot opposite the opening.

3. The stapler assembly of claim 2, wherein the infeed slot defines an infeed axis, wherein the infeed axis is oriented with respect to the base at a first incline angle when the stapler is in the first position, and wherein the infeed axis is oriented with respect to the base at a second incline angle when the stapler is in the second position.

4. The stapler assembly of claim 1, wherein the base includes a holster configured to receive the stapler.

5. The stapler assembly of claim 4, wherein the holster is pivotable to move the stapler between the first and second positions.

6. The stapler assembly of claim 4, wherein the base further includes a cradle for supporting the holster and for supporting at least a portion of the stapler when the stapler is in at least one of the first and second positions.

7. The stapler assembly of claim 6, wherein the base includes a detent mechanism between the cradle and the holster, the detent mechanism having at least two detents corresponding with the first and second stapler positions.

8. The stapler assembly of claim 6, wherein at least one of the cradle and holster includes the electrical conductor configured to conduct power from the power supply to the stapler when the stapler is received in the holster.

9. A base assembly for supporting a stapler having a rear end, a bottom surface, a top surface, and opposing side surfaces, the base assembly comprising:

a cradle; and a holster coupled to the cradle, the holster being configured to receive the rear end of the stapler such that the holster engages at least a portion of each of the bottom surface, the top surface, and the opposing side surfaces.

10. The base assembly of claim 9, wherein the holster is movable with respect to the cradle between a first position and a second position.

11. The base assembly of claim 10, wherein the holster is pivotable between the first and second positions.

12. The base assembly of claim 10, wherein the base assembly further comprises a detent mechanism between the cradle and the holster, the detent mechanism having at least two detents corresponding with the first and second positions.

13. The base assembly of claim 10, wherein the holster is further movable to a third position.

14. The base assembly of claim 9, wherein at least one of the cradle and holster includes an electrical conductor configured to conduct power from a power supply to a stapler when the stapler is received in the holster.

15. A stapler assembly comprising:

an electric stapler: and a base configured to removably support the stapler, the base having an electrical connector electrically connected to a power supply such that when the stapler is supported by the base, the connector is coupled to the stapler to provide power to the stapler;

wherein the base includes a cradle and a holster coupled to the cradle, the holster being configured to receive a portion of the stapler.

16. The stapler assembly of claim 15, wherein the electrical connector is on the holster.

17. The stapler assembly of claim 15, wherein the electrical connector is electrically connected to a power supply cord plugged into the cradle.

18. The stapler assembly of claim 15, wherein the holster is movable with respect to the cradle and wherein the electrical connector is on the holster, and further comprising:

a power supply cord plugged into the cradle; and a flexible conductor connected between the power supply cord and the electrical connector to maintain an electrical connection between the holster and the cradle during movement of the holster.

19. A stapler assembly comprising:

a base; and a stapler coupled to the base, the stapler being movable with respect to the base between a first position, wherein the stapler has a first orientation with respect to the base, and a second position, wherein the stapler has a second orientation with respect to the base;

wherein the base includes a holster configured to receive the stapler and a cradle for supporting the holster and for supporting at least a portion of the stapler when the stapler is in at least one of the first and second positions; and wherein the stapler is an electric stapler and wherein at least one of the cradle and holster includes an electrical conductor configured to conduct power from a power supply cord to the stapler when the stapler is received in the holster.

20. The stapler assembly of claim 19, wherein the stapler includes a body portion defining an infeed slot;

a magazine adjacent a first side of the infeed slot, the magazine including an opening for dispensing a staple; and an anvil adjacent a second side of the infeed slot opposite the opening.

21. The stapler assembly of claim 20, wherein the infeed slot defines an infeed axis, wherein the infeed axis is oriented with respect to the base at a first incline angle when the stapler is in the first position, and wherein the infeed axis is oriented with respect to the base at a second incline angle when the stapler is in the second position.

22. The stapler assembly of claim 19, wherein the holster is pivotable to move the stapler between the first and second positions.

23. The stapler assembly of claim 19, wherein the base includes a detent mechanism between the cradle and the holster, the detent mechanism having at least two detents corresponding with the first and second stapler positions.

24. A base assembly for supporting a stapler, the base assembly comprising:

a cradle; and a holster coupled to the cradle, the holster being configured to receive a portion of a stapler;

wherein at least one of the cradle and holster includes an electrical conductor configured to conduct power from a power supply to a stapler when the stapler is received in the holster.

25. The base assembly of claim 24, wherein the holster is movable with respect to the cradle between a first position and a second position.

26. The base assembly of claim 25, wherein the holster is pivotable between the first and second positions.

27. The base assembly of claim 25, wherein the base assembly further comprises a detent mechanism between the cradle and the holster, the detent mechanism having at least two detents corresponding with the first and second positions.

28. The base assembly of claim 25, wherein the holster is further movable to a third position.

* * * * *